United States Patent [19]

Kondo et al.

[11] Patent Number: 4,969,260

[45] Date of Patent: Nov. 13, 1990

[54] METHOD OF FORMING A CONDUCTOR CONNECTION STRUCTURE OF CRIMP CONTACT

[75] Inventors: Hiroki Kondo; Hirokazu Kumura, both of Shizuoka, Japan

[73] Assignee: Yazaki Corporation, Tokyo, Japan

[21] Appl. No.: 358,763

[22] Filed: May 30, 1989

[30] Foreign Application Priority Data

May 31, 1988 [JP] Japan ..... 63-131709

[51] Int. Cl.[5] ..... H01R 43/04

[52] U.S. Cl. ..... 29/863; 29/877

[58] Field of Search ..... 29/863, 877; 439/203, 439/519

[56] References Cited

U.S. PATENT DOCUMENTS 4,214,121 7/1980 Charneski et al. ..... 439/877 X 4,600,804 7/1986 Howard ..... 174/84 C

*Primary Examiner*—Timothy V. Eley

*Attorney, Agent, or Firm*—Sughrue, Mion, Zinn, Macpeak & Seas

[57] ABSTRACT

A crimp contact for providing a secure mechanical and electrical contact between wire conductors and a contact portion, includes a moisture-impermeable cross-linking adhesive filling the gaps between the crimp portion of the crimp contact and the wire conductors, and between adjacent wire conductors. The adhesive is cross-linked subsequent to filling the gaps, thereby hardening the adhesive.

6 Claims, 1 Drawing Sheet

METHOD OF FORMING A CONDUCTOR CONNECTION STRUCTURE OF CRIMP CONTACT

BACKGROUND OF THE INVENTION

1. Field of the Invention

The present invention generally relates to a conductor connection structure in a conductor crimp portion of a crimp contact, and particularly relates to a crimp contact having a highly reliable conductor connection structure.

2. Description of the Prior Art

As shown in FIG. 4, conventionally, a crimp contact is constituted by a contact portion 1, a conductor crimp portion 2 continued from the contact portion 1, and a coating fastening portion 3 continued from the conductor crimp portion 2. In such a crimp contact, the conductor crimp portion 2 and the coating fastening portion 3 are formed in such a manner that opposite ends of a plate-like portion continued from the contact portion 1 are bent upward and end portions of the opposite ends are further curved inward so as to form grasping arms 2*a* and 3*a* so that spaces are formed, respectively, for accommodating wire conductors 4 plus a coating 5 over the wire conductors.

In this configuration of the crimp contact, the conductors 4 where the coating 5 has been removed and the conductors 4 where the coating 5 is left as it is are inserted into the conductor crimp portion 2 and the coating fastening portion 3, respectively, and the grasping arms 2*a* and 3*a* are fastened by use of a fastening tool so that the grasping arms 2*a* and 3*a* are plastically deformed to come into close contact with the conductors 4 and with the coating 5, respectively. Even after removal of the fastening force of the fastening tool, the grasping arms 2*a* and 3*a* are urged against the conductors 4 and the coating 5 by residual elastic force in the grasping arms 2*a* and 3*a*. respectively.

If the contact urging force of the grasping arm 2*a* against the conductors 4 is insufficient, the contact between the grasping arm 2*a* and the conductors 4 is insufficient so that the electric resistance between the conductor crimp portion 2 and the conductors 4 increases to thereby cause failures such as heat generation or burnout, or so that the contact is loosened or dropped out by an external force to thereby cause a maloperation or operation stoppage of equipment connected to the crimp contact. It is therefore necessary to strictly control the size of the conductor crimp portion 2.

Since each conductor 4 has a substantially circular section, air gaps 6 are produced between the conductor crimp portion 2 and the conductors 4 and between the adjacent conductors 4 so that an oxide film or the like is generated on the outer surfaces of the conductors 4 and on the inner surface of the conductor crimp portion 2. This increases the electric resistance between the conductors 4 and the conductor crimp portion 2 as time elapses to thereby cause a defective contact.

In order to prevent a defective contact from occurring, soldering is sometimes performed. In that case, however, the step of soldering constitutes an additional step. Also, the solder becomes hard and hence fragile, and even if no defective contact is created due to the soldering, when vibrations or the like are applied to the soldered portion, that portion may be easily disconnected.

SUMMARY OF THE INVENTION

It is therefore an object of the present invention to solve the foregoing problems of the prior art.

It is another object of the present invention to provide a conductor connection structure of a crimp contact in which a highly-reliable crimp connection can be realized and the high reliability of the crimp connection can be maintained for a long time.

In order to attain the above objects, according to the present invention, the conductor connection structure of a crimp contact has a configuration in which air-gap portions formed between an inner surface of a conductor crimp portion and conductors are filled with a moisture-impermeable cross-linking adhesive. Such a conductor connection structure can be realized by a method of forming a conductor connection structure of a crimp contact comprising the steps of inserting conductors into a conductor crimp portion of the crimp contact, pouring a moisture-impermeable cross-linking adhesive having fluidity into the conductor crimp portion, and fastening the conductor crimp portion so as to wrap the conductors.

The moisture-impermeable cross-linking adhesive to be used according to the present invention has fluidity in an unhardened state, and loses the fluidity when hardened by cross-linking. The cross-linking adhesive includes polymerization-setting adhesives. As such an adhesive, it is preferable to use a liquid one, for example, an epoxy adhesive, an acryl adhesive, a silicone adhesive, or the like.

The process for filling the gap portions formed between the inner surface of the conductor crimp portion and the conductors with such an adhesive is not particularly limited. If filling is performed after fastening, however, the filling is apt to be imperfect and uneconomical because the adhesive adheres also to unnecessary external portions. It is therefore preferable to use such a method in which the conductors are inserted into the conductor crimp portion and at the same time the adhesive is poured into the conductor crimp portion, although it is possible to use a method in which the adhesive is applied in advance onto the inner surface of the conductor crimp portion or the conductors to be inserted and then the conductors are inserted into the conductor crimp portion. After the conductors have been inserted into the conductor crimp portion and the adhesive has been applied thereto as described above, the conductor crimp portion is crimped to form a solderless connection together with the conductors by the conventional fastening means, and if necessary the adhesive is hardened by cross-linking by heating or the like.

In the method according to the present invention, contact between the inner surface of the conductor crimp portion and the conductors is not prevented by the adhesive, but the gaps in the inside of the conductor crimp portion are efficiently filled with the adhesive. Further, the inner surface of the conductor crimp portion and the outer surfaces of the conductors are covered with the moisture-impermeable adhesive, and at the same time securely connected to each other. Therefore, there is no risk that the surfaces of the conductor crimp portion and conductors are oxidized so as to increase the contact resistance therebetween, and there is no risk of generation of defective contact due to external force.

BRIEF DESCRIPTION OF THE DRAWINGS

These and other features, objects and advantages of the present invention will be apparent form the following detailed description with reference to the accompanying drawings.

DETAILED DESCRIPTION OF THE PREFERRED EMBODIMENT

Figure 1:
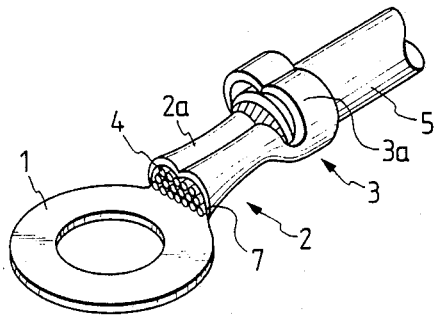
FIG. 1 is a perspective view of an example of a crimp contact having the conductor connection structure according to the present invention.
Figure 2:
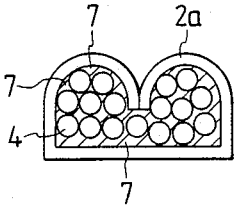
FIG. 2 is a cross section showing the conductor crimp portion of the crimp contact of FIG. 1.
Figure 4:
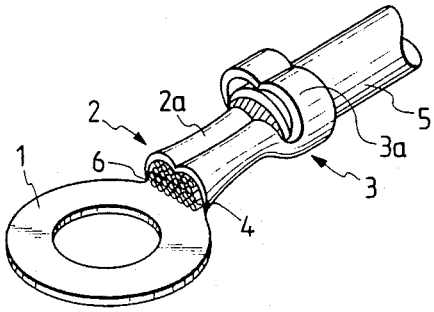
FIG. 4 PRIOR ART
FIG. 4 is a perspective view showing a crimp contact having the conventional structure.

Referring to FIGS. 1 and 2, a description will be provided herein of an example of a crimp contact having a conductor connection structure according to the present invention. In the crimp contact of FIG. 1, portions the same as those in the conventional one of FIG. 4 are correspondingly referenced. The conductor connection structure according to the present invention is, however, different from the conventional one in that the gaps 6 formed between the conductor crimp portion 2 and the conductors 4 and between the respective conductors 4 are filled with a cross-linking adhesive 7.

Such a conductor connection structure according to the present invention can be produced without reducing the productivity in manufacturing the conventional crimp contacts. A conventional crimping machine of the type used to attach the crimp contact to the conductor may be used. The machine, however, is additionally provided with an apparatus for pouring a predetermined quantity of cross-linking adhesive into a conductor crimp portion of a crimp contact.

As an example, the connection structure according to the present invention was produced as follows. First a thermosetting epoxy adhesive was accommodated in the adhesive pouring apparatus in advance, and a crimp contact was mounted on the crimp machine. Conductors 4 of wire were inserted into a conductor crimp portion 2 of the crimp contact, and at the same time the epoxy adhesive was poured into the conductor crimp portion 2. Next, pressure was exerted on to the conductor crimp portion 2 by means of a fastening tool so as to bend and deform a grasping arm 2*a* of the conductor crimp portion 2 so that the grasping arm 2*a* was pressed against the conductors 4 and the epoxy adhesive 7 was completely extended into the gaps 6. After completion of crimp, the crimp contact was accommodated in a moisturized vessel so as to accelerate cross-linking, so that the conductor crimp portion 2 and the conductors 4 were securely bonded with each other. As a result, the contact between the conductor crimp portion 2 and the conductors 4 showed an exceedingly stabilized state also mechanically.

Figure 3:
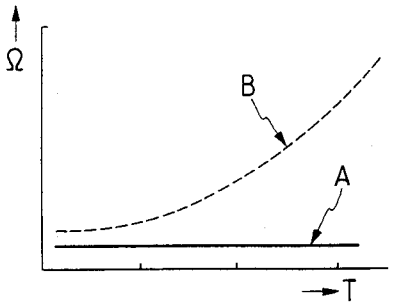
FIG. 3 is a graph showing the result of an endurance test of the electric resistance in the conductor connection structure.

The epoxy adhesive used in this case has a moisture-impermeable property, which is so high that neither oxidation nor corrosion is caused on a metal surface of the crimp portion even under unfavorable conditions of high temperature and high humidity. FIG. 3 shows the results of an endurance test for proving the fact that the electric resistance in the conductor connection structure according to the present invention maintains a stable value for a long time. FIG. 3 shows the time aging of the electric resistance of the conductor crimp portion under the conditions of high temperature and high humidity. As seen from the drawing, the electric resistance A of the conductor crimp portion having the connection structure according to the present invention is exceedingly stable, while the electric resistance B of a conductor crimp portion having the conventional structure increases as time elapses.

The conductor connection structure of a crimp contact according to the present invention can be easily formed by additionally providing a simple apparatus to the conventional contact crimping machine, and therefore a highly reliable conductor connection structure can be obtained without reducing the efficiency of crimping work. The connection structure according to the present invention provides secure mechanical grasping and secure electrical contact even under conditions of relaxed supervision of the tolerance for the crimping portion, and such performance can be maintained for a long time even under unfavorable conditions.

What is claimed is:

1. A method of forming a conductor connection structure of a crimp contact, said structure including a contact portion extending from a crimp portion on a side thereof away from a plurality of wire conductors, and a coating fastening portion extending from the opposite side of said crimp portion; said method comprising the steps of:

inserting said wire conductors into said conductor crimp portion of said crimp contact;

pouring a moisture-impermeable cross-linking adhesive having fluidity into said conductor crimp portion; and crimping said conductor crimp portion and said coating fastening portion to an exposed portion of said wire conductors and a coated portion of said wire conductors, respectively.

2. The method of claim 1, wherein said adhesive is a polymerization setting adhesive.

3. The method of claim 2, wherein said adhesive is selected from the group consisting of epoxy adhesive, acryl adhesive, and silicone adhesive.

4. The method of claim 1, wherein said adhesive is a thermosetting epoxy adhesive.

5. The method according to any of claims 1-6, further comprising the step of cross-linking said adhesive to harden said adhesive to form a secure mechanical and electrical contact between said crimp portion and said conductors.

6. The method of claim 1, wherein said steps of inserting said wire conductors into said conductor crimp portion and pouring said adhesive into said conductor crimp portion are carried out simultaneously.

* * * * *